US006330887B1

(12) United States Patent
Chen

(10) Patent No.: US 6,330,887 B1
(45) Date of Patent: Dec. 18, 2001

(54) STRUCTURE OF THE MAIN SHAFT OF AN UMBRELLA

(76) Inventor: Chuan Tsai Chen, P.O. Box 82-144, Taipei (TW)

( * ) Notice: Subject to any disclaimer, the term of this patent is extended or adjusted under 35 U.S.C. 154(b) by 0 days.

(21) Appl. No.: 09/542,845

(22) Filed: Apr. 4, 2000

(51) Int. Cl.[7] ..... A45B 3/00

(52) U.S. Cl. ..... 135/16; 135/25.4; 135/98; 135/120.3; 135/114

(58) Field of Search ..... 135/15.1, 16, 114, 135/98, 99, 25.4, 120.3; 52/155, 157

(56) References Cited

U.S. PATENT DOCUMENTS

| | | | | |
|---|---|---|---|---|
| 4,836,232 | * | 6/1989 | De Rosa | 135/99 |
| 5,152,495 | * | 10/1992 | Jacinto | 135/98 |
| 5,156,369 | * | 10/1992 | Tizzoni | 135/98 |
| 5,293,889 | * | 3/1994 | Hall et al. | 135/16 |
| 5,396,915 | * | 3/1995 | Bomar | 135/16 |
| 5,906,077 | * | 5/1999 | Adriarena | 135/98 |
| 5,964,237 | * | 10/1999 | Lin | 135/114 |
| 6,073,642 | * | 6/2000 | Huang | 135/114 |

* cited by examiner

*Primary Examiner*—Beth A. Stephan
(74) *Attorney, Agent, or Firm*—A & J

(57) ABSTRACT

An improved structure of the main shaft of a large size umbrella comprising an umbrella structure and an eccentric engaging element, characterized in that the umbrella structure includes an umbrella body, the main shaft an inner shaft and the eccentric engaging element includes an eccentric rotating gear cover and an eccentric shaft, and the eccentric rotating shaft is mounted within an eccentric slot of the eccentric shaft and is disposed at an eccentric post, which provides restriction and rotatably mounting function, a tolerance slot is provided at the eccentric rotating gear cover, and the edge of the eccentric rotating gear slot is threaded and the bottom section thereof is provided with an arch-shaped notch, which is corresponding to a protruded blocking section located at the bottom edge of the eccentric shaft, and the eccentric engaging element is mounted at the head end of the inner shaft and the inner shaft is located within the hollow body of the main shaft, a rolling slot is provided at the lower section of the main shaft to restrict the eccentric engaging element to avoid the dislocation of the inner shaft, thereby a retractable shaft structure for the large size umbrella is obtained.

1 Claim, 6 Drawing Sheets

STRUCTURE OF THE MAIN SHAFT OF AN UMBRELLA

BACKGROUND OF THE INVENTION a)Technical Field of the Invention

The present invention relates to an improved structure of the main shaft of an umbrella.

b) Description of the Prior Art

FIG. 1 shows a conventional collapsible, large size umbrella comprising a main shaft A1 and an auxiliary extension shaft A2. The bottom section of the main shaft A1 is provided with a positioning elastic ball A11 which positions the extension shaft A2 at the position hole A21 after the main shaft A1 is inserted thereto. The rotating eccentric pressing shaft A3 at the top end of the extension shaft A2 is used to mount the main shaft A1 to the extension shaft A2. The eccentric pressing shaft A3 is urged by a press shaft A31 to eccentrically secure with the extension shaft A2. Loosening the press shaft A31 causes the main shaft A1 to disengage from the extension shaft A2 and the umbrella structure can be unloaded.

The drawbacks of the conventional collapsible umbrella are as follows:

1) As the conventional umbrella requires two parts for combination to form the entire umbrella, the manufacturing of elements is complicated. As a result, unnecessary cost of production will occur.
2) As a result of the two independent parts of the umbrella, it is possible that one of the parts may be displaced, and the umbrella cannot be used.
3) Due to the weight of the umbrella, it is rather troublesome to assemble the two independent parts under strong wind environment
4) The rotating eccentric pressing shaft A3 provides insufficient stress and therefore, connection of the main shaft A1 and the extension shaft A2 by urging is weak, and the umbrella may fall down as a result of accidental impact.
5) After a long period of use of the umbrella, the main shaft A1 may be dented, and the urging by the rotating eccentric pressing shaft A3 is weak.
6) The dented main shaft A1 of the umbrella may be eroded in due course.

SUMMARY OF THE INVENTION

Accordingly, it is an object of the present invention to provide an improved structure of the main shaft of a large size umbrella comprising an umbrella structure and an eccentric engaging element, characterized in that the umbrella structure includes an umbrella body, the main shaft, an inner shaft and the eccentric engaging element includes an eccentric rotating gear cover and an eccentric shaft, and the eccentric rotating shaft is mounted within an eccentric slot of the eccentric shaft and is disposed at an eccentric post, which provides restriction and rotatably mounting function, a tolerance slot is provided at the eccentric rotating gear cover, and the edge of the eccentric rotating gear slot is threaded and the bottom section thereof is provided with an arch-shaped notch, which is corresponding to a protruded blocking section located at the bottom edge of the eccentric shaft, and the eccentric engaging element is mounted at the head end of the inner shaft and the inner shaft is located within the hollow body of the main shaft, a rolling slot is provided at the lower section of the main shaft to restrict the eccentric engaging element to avoid the dislocation of the inner shaft, thereby a retractable shaft structure for the large size umbrella is obtained.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
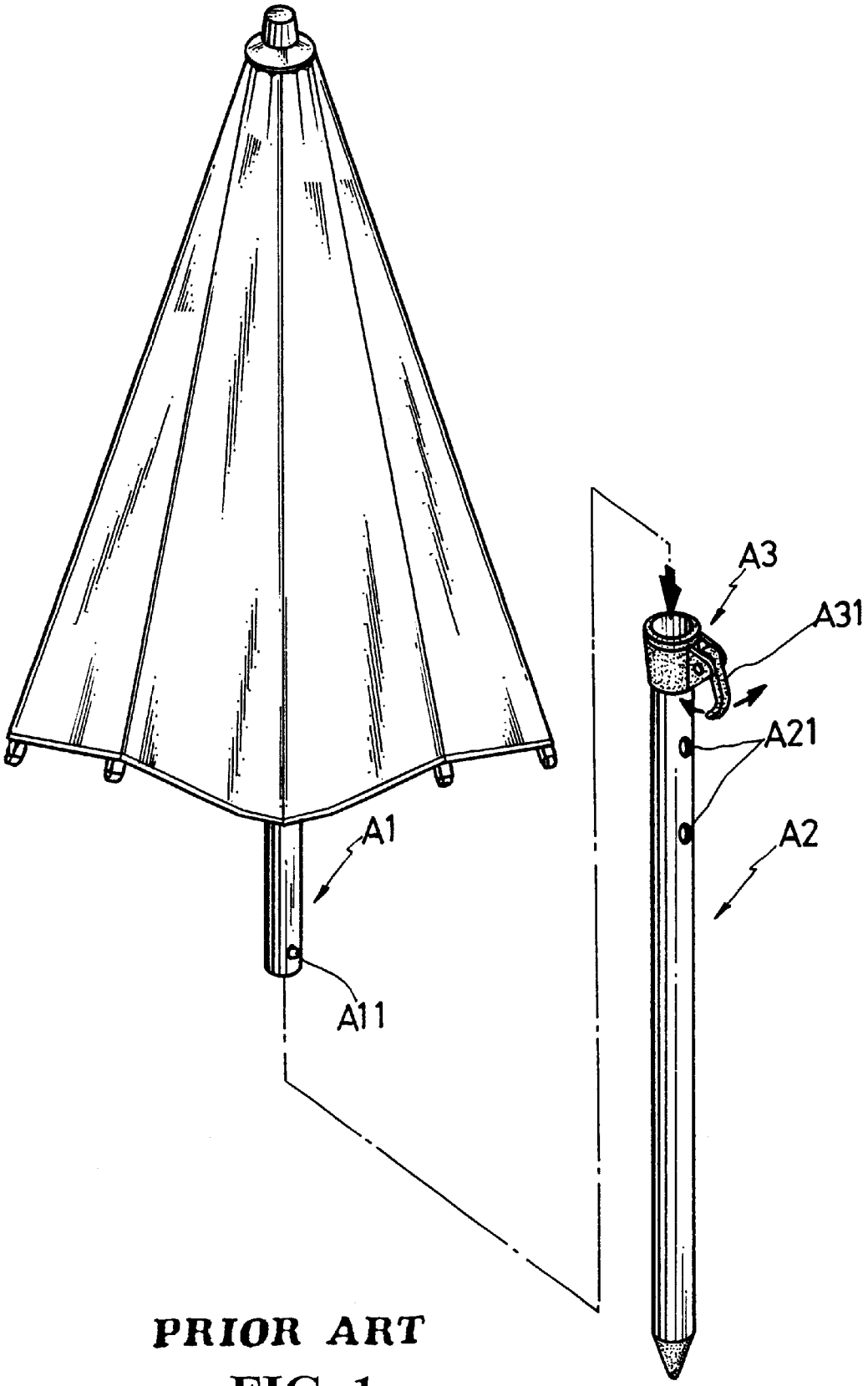
PRIOR ART FIG. 1
FIG. 1 is a perspective exploded view of a conventional large size umbrella.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
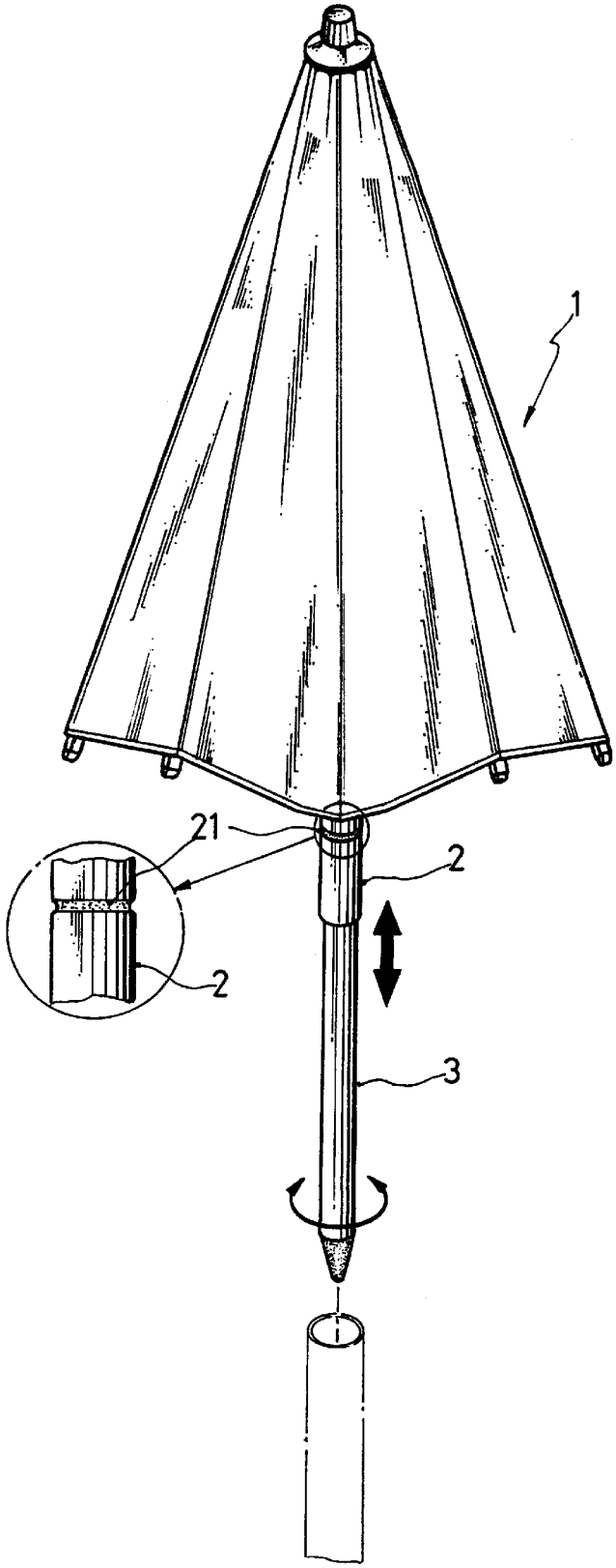
FIG. 2 is a schematic view of a preferred embodiment of the large size umbrella of the present invention.
Figure 3:
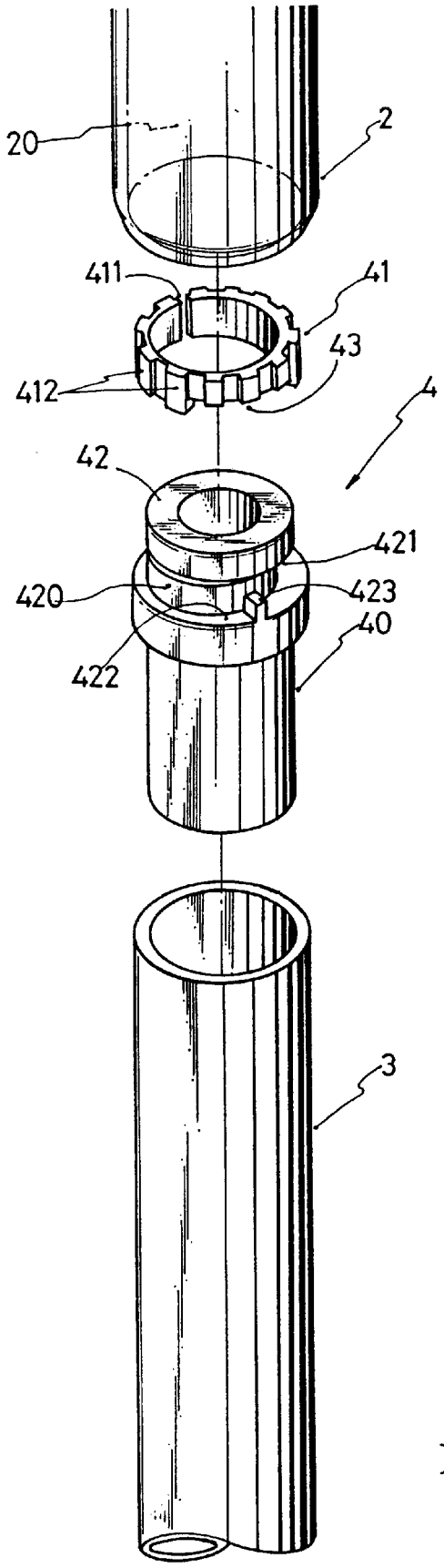
FIG. 3 is a perspective exploded view of the eccentric engaging element in accordance with the present invention.

Referring to FIGS. 2 and 3, the entire umbrella structure comprises an umbrella body 1, a main shaft 2, an inner shaft 3 and an eccentric engaging element 4 (FIG. 3). The eccentric engaging element 4 has a base post seat 40 insertably mounted at the end section of the inner shaft 3 such that the eccentric engaging element 4 becomes the head end of the inner shaft 3, which is inserted into the hollow body 20 of the main shaft 2. Thus, a retractable shaft body is thus obtained. The main shaft 2 is a main structure of the umbrella body 1, and the lower end of the main shaft 2 is provided with a rolling slot 21. The rolling slot 21 is used to restrict the eccentric engaging element 4 so that the inner shaft 3 will not dislocated therefrom. The rolling slot 21 is the blocking ring for the inner shaft 3 when it is stretched to the maximum.

Referring to FIGS. 2 to 5, the eccentric engaging element 4 includes an eccentric rotating gear cover 41 and an eccentric shaft 42. The eccentric rotating gear cover 41 is provided with a tolerance slot 411, and the edge of the cover 41 is provided with threaded structure 412. The threaded structure 412 can grip hold of the main shaft 2. The eccentric rotating gear cover 41 is provided to the eccentric slot 421 of the eccentric shaft 42 so as to enclose the eccentric post 420 and to provide rotatably pivoting function.

The bottom section of the eccentric rotating gear cover 41 is provided with an appropriate width arch-shaped slot 43. The slot 43 is corresponding to the protruded blocking section 423 at the bottom edge scat 422 of the eccentric shaft 42, such that the slot 43 is the position for engaging and disengaging of the rotating eccentric cover 41.

Figure 8:
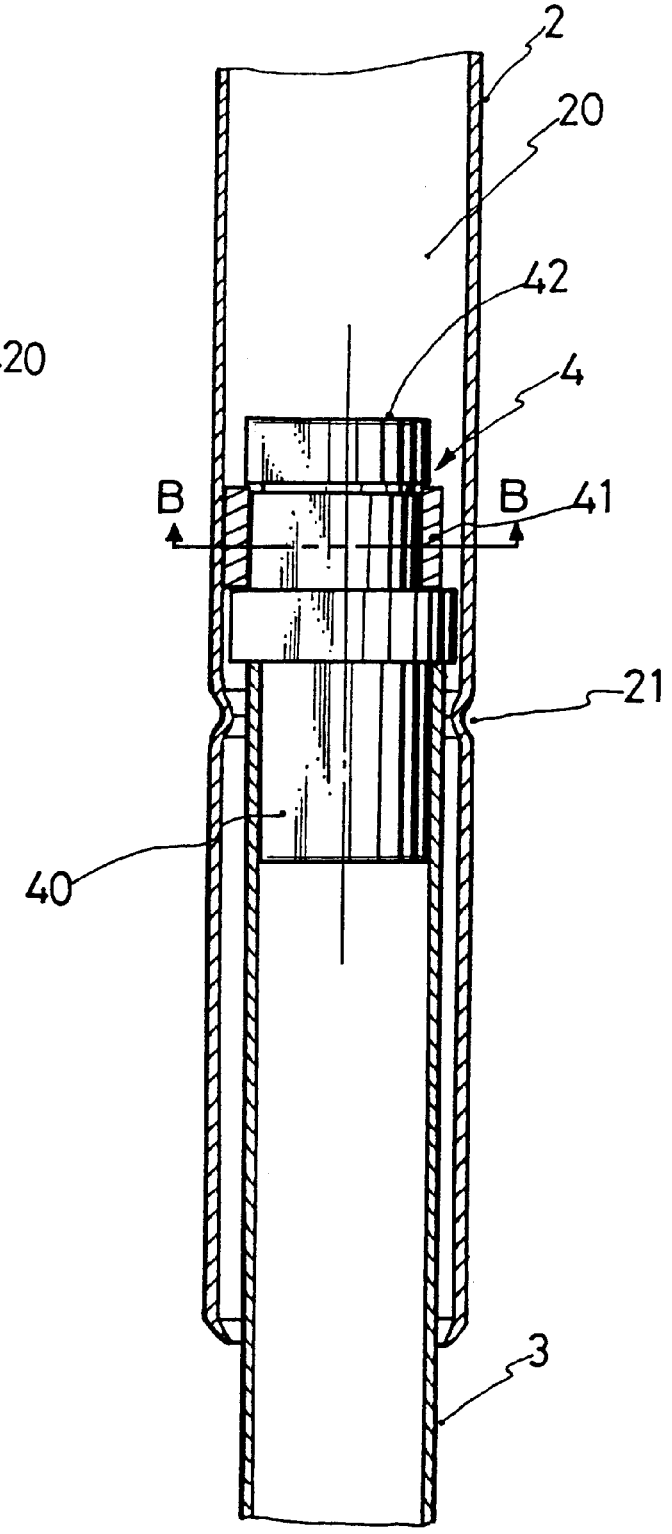
FIG. 8 is sectional view showing the entire structure comprising the main shaft, the inner shaft and the eccentric engaging element of the present invention.

FIG. 8 shows the operation of the umbrella of the present invention. The inner shaft 31 is pulled up to the required height (the maximum height is determined by the position of the rolling slot 21), and at this instance, rotate the inner shaft 3, and the eccentric engaging element 4 at the head end is engageably connected as a result of the eccentricity of the eccentric element—such that the inner shaft 3 can be secured within the main shaft 2.

Figure 4:
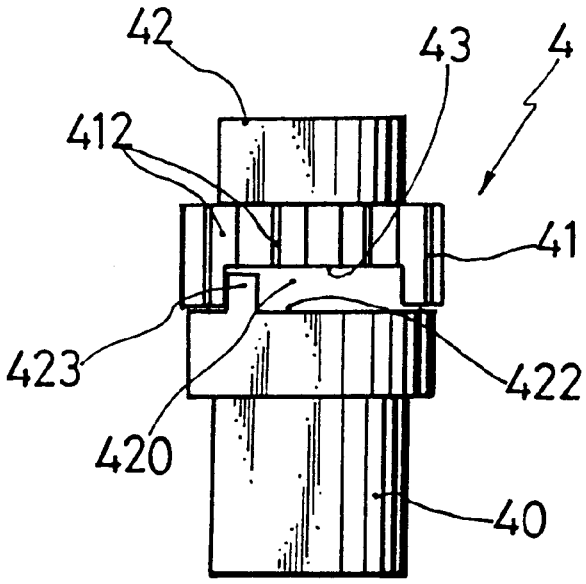
FIG. 4 is a schematic view showing the eccentric engaging element at disengagement position in accordance with the present invention.
Figure 5:
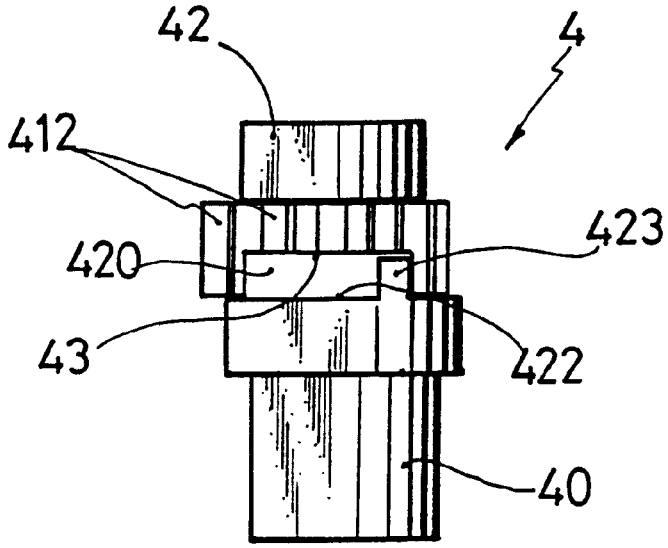
FIG. 5 is a schematic view showing the eccentric engaging element at engagement position in accordance with the present invention.
Figure 6:
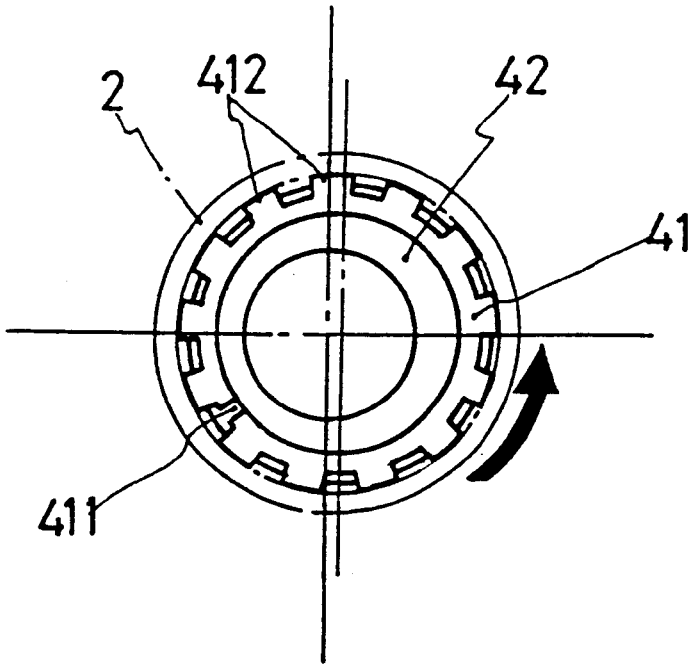
FIG. 6 is a top view of the eccentric engaging element at disengagement position in accordance with the present invention.
Figure 7:
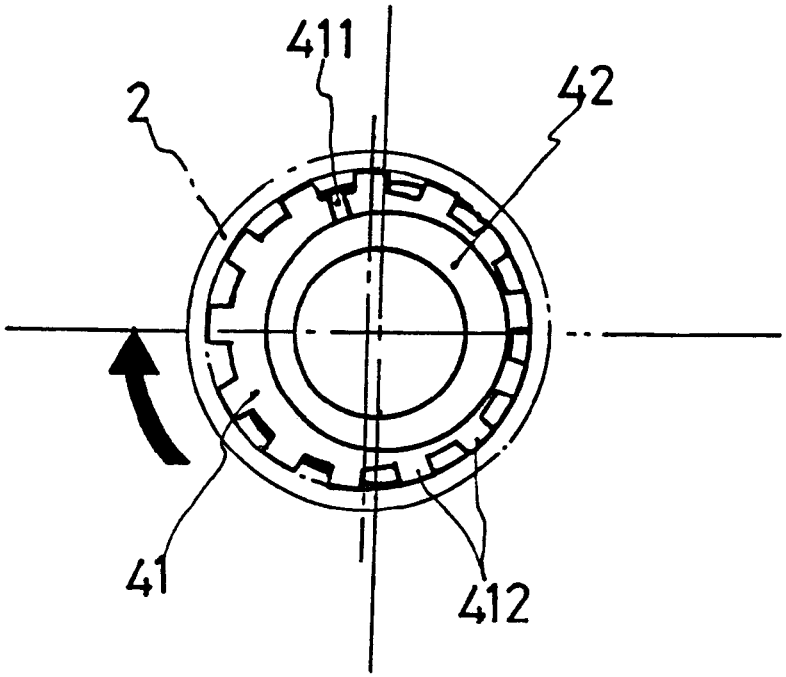
FIG. 7 is a top view of the eccentric engaging element at engagement position in accordance with the present invention.

If the umbrella is to be disengaged from the inner shaft 3, rotate the inner shaft 3 such that the eccentric engaging element 4 is disengaged. The function and effectiveness of the engagement can be seen in FIGS. 4 to 7. As the eccentric rotating gear cover 41 and the eccentric shaft 42 both have eccentric characteristics, the eccentric rotating gear cover 41 urges the inner wall of the main shaft 42 and the entire eccentric engaging element 4 produces a variation in eccentrical distance. The variation of the eccentrical distance is the force exertion at the inner wall of the main shaft 2, as shown in FIGS. 5 and 7. If the inner wall is rotated in opposite direction of the main shaft 2, the eccentric shaft 42 will rotate in a normal state, as shown in FIGS. 4 and 6, and thus, a disengagement is obtained. Thus, the inner shaft 3 can be retractably operated.

Figure 9:
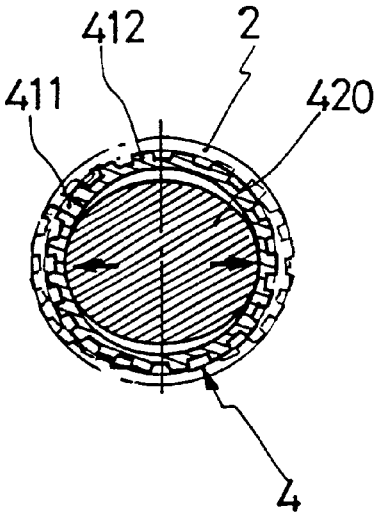
FIG. 9 is the cross section B—B from FIG. 8.

Referring to FIG. 9, the eccentric post 420 of the eccentric engaging element 4 is an oval shape. When eccentric post 420 is rotated within the inner shaft 3, as a result of the principle of eccentricity, the rotating gear cover 41, in accordance with the long shaft of the eccentric post 420, causes a bi-direction urging at the inner wall of the main shaft 2 so as to achieve a strong engagement.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An umbrella comprising a main body, a main shaft, an inner shaft, and an eccentric engaging element rotatably connecting the main shaft and the inner shaft, the engaging element comprising an eccentric shaft and a gear cover, the eccentric shaft having a slot therein and an oval-shaped post adjacent the slot, the eccentric shaft having a blocking section adjacent the slot and a seat, the gear cover having a slot formed in a bottom thereof for receiving the blocking section rotatably therein, the gear cover having a tolerance slot, and an outer edge of the gear cover is threaded to grip the inside of the main shaft, and a rolling slot is provided at a lower section of the main shaft to restrict movement of the engaging element with respect to the inner shaft, the seat of the engaging element is received in the inner shaft.

* * * * *